United States Patent [19]

Krogh

[11] 4,202,147

[45] May 13, 1980

[54] SILO

[76] Inventor: Georg Krogh, 10 Sycamore St., Leeton, N.S.W., Australia

[21] Appl. No.: 938,231

[22] Filed: Aug. 30, 1978

[30] Foreign Application Priority Data

Sep. 5, 1977 [AU] Australia ..... PD1505

[51] Int. Cl.[2] ..... E04H 7/00

[52] U.S. Cl. ..... 52/245; 52/273

[58] Field of Search ..... 52/245, 246, 248, 247, 52/249, 573, 192, 197, 224

[56] References Cited

U.S. PATENT DOCUMENTS

| | | | |
|---|---|---|---|
| 1,718,729 | 6/1929 | Bayley | 52/247 |
| 2,361,272 | 10/1944 | Covey | 52/247 |
| 3,833,944 | 9/1974 | Goetti | 52/247 |
| 4,074,485 | 2/1978 | Hendriks | 52/247 |

FOREIGN PATENT DOCUMENTS

| | | | |
|---|---|---|---|
| 533972 | 6/1929 | Fed. Rep. of Germany | 52/245 |

*Primary Examiner*—John E. Murtagh

*Attorney, Agent, or Firm*—Dennison, Dennison, Meserole & Pollack

[57] ABSTRACT

The present invention relates to a circular storage silo comprising wall members connected to vertical columns, the arrangement being such that loads at the base of the silo are transferred evenly to base members secured to footings.

6 Claims, 13 Drawing Figures

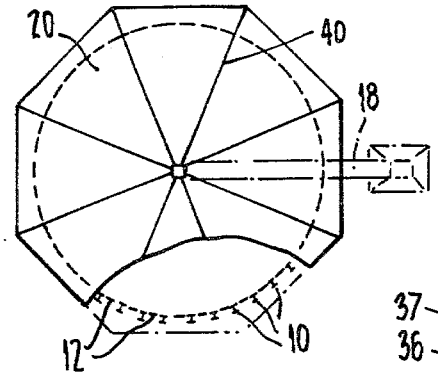
FIG. 1.
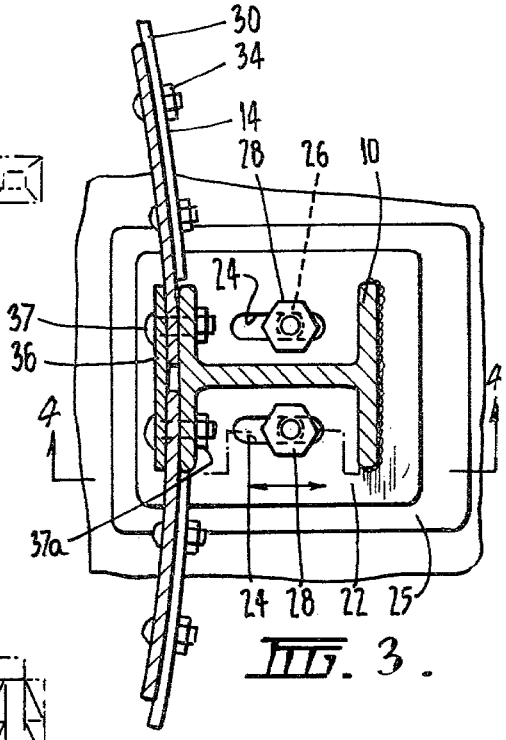
FIG. 3.
FIG. 2.
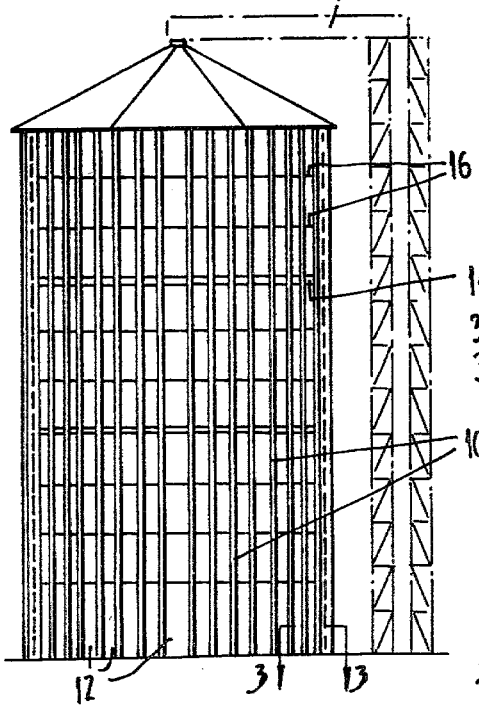
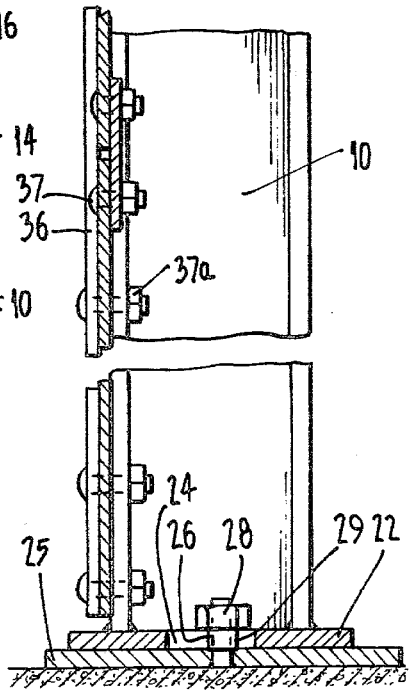
FIG. 4.

SILO

The present invention relates to storage silos for storing materials such as grain, coal, gravel or flour.

Known silos are generally constructed strongly enough to avoid deformation in any direction by using thicker walls than actually required for the retention of the stored materials. In a typical construction a ring of angle iron is placed at the bottom and secured to the foundation.

In accordance with one aspect of the present invention there is provided a circular storage silo comprising wall members connected to vertical columns, the arrangement being such that loads at the base of the silo are transferred evenly to base members secured to footings.

For example, the columns may be arranged to be moved radially outwardly under load.

With the silo of this embodiment of the present invention the bin walls are able to be deformed in a controlled manner when the silo contains stored material. This deformation produces perimetric tension in the wall members ensuring the best utilisation of the material from which the wall members are constructed such as steel.

Alternatively, the columns may be truncated above ground level and a load resistant wall member mounted between the columns and the base members.

Also, as will be described hereinafter, the silo of the present invention may be constructed with a smooth interior to ensure a contamination free surface and the wall panels may be bolted together and to support members so avoiding the need for on site welding which is an expensive operation as well as being difficult to control.

The present invention will now be described, by way of example, with reference to the accompanying drawings, in which:

FIG. 1 is a schematic plan view of a storage silo in accordance with the present invention;

FIG. 2 is a side elevation of the storage silo of FIG. 1;

FIG. 3 is a plan view of one form of construction and jointing of wall members of the silo of FIGS. 1 and 2;

FIG. 4 is a fragmentary side elevation of the form of construction and jointing of wall members shown in FIG. 3;

Figure 5:
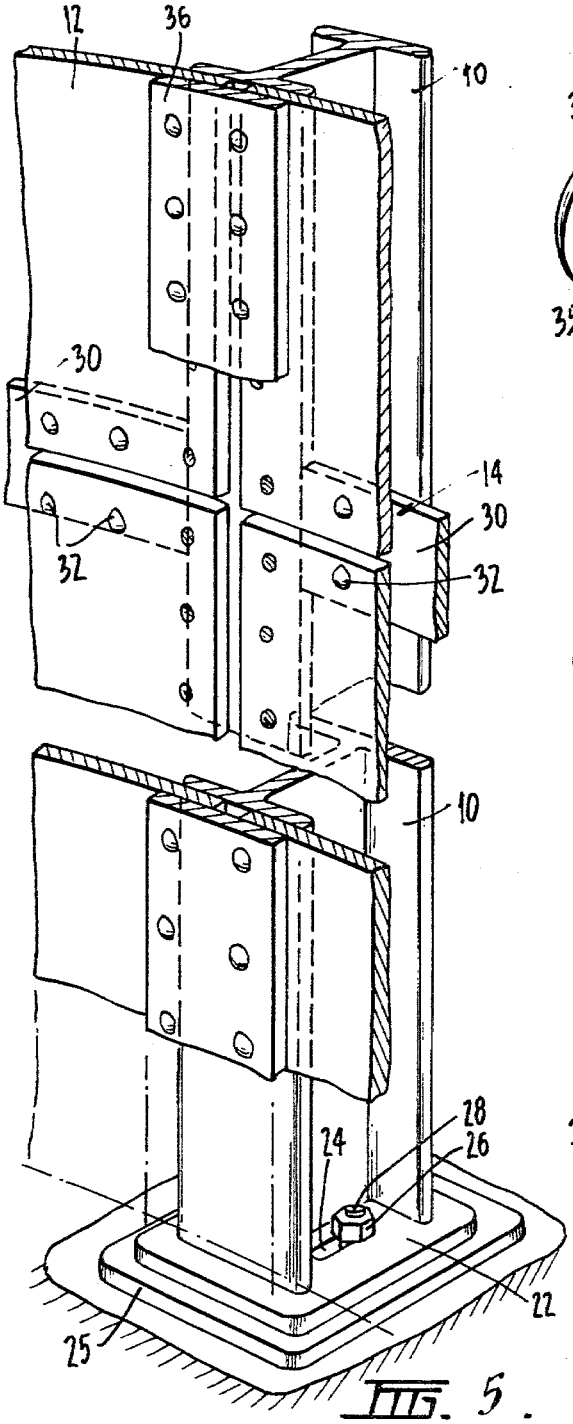
FIG. 5 is a fragmentary perspective view of the form of construction and jointing of wall members shown in FIG. 3.

In FIGS. 1 and 2 there is shown a storage silo in accordance with one embodiment of the present invention mounted on a footing (not shown) preferably formed of reinforced concrete. The silo comprises a plurality of substantially equally spaced vertical columns 10 arranged in a circle. The section of the columns used is not critical providing they have adequate strength for their intended purpose.

The spaces between each adjacent pair of columns is closed by wall panels 12. As shown, the vertical space between each pair of columns 10 is closed by three vertically elongated wall panels 12 joined together by bolted joints 14 which will be described in detail in connection with FIGS. 3 to 5.

Each wall panel 12 is composed of a plurality of sheets as shown by the horizontal lines 16 in FIG. 2. The sheets are welded together prior to despatch to the site at which the silo is to be constructed. Further, each column is formed of a plurality of sections such as three in the construction shown in FIG. 1. The column sections are delivered to the site and erected thereat with the sections joined together such as by cleats. Preferably, the lengths of the column sections are so arranged that the joints between them do not coincide with the bolted joints 14.

As shown in FIGS. 1 and 2 the silo is arranged to be connected to a gantry system 18 for loading through roof 20. The gantry system 18 is of conventional construction.

Turning now to FIGS. 3 to 5 it can be seen that the column section mounted on the ground is provided at its lowermost end with a base plate 22. The base plate 22 is welded to the column section. Further, the base plate 22 is provided with a pair of slots 24.

In use, each base plate 22 is positioned on a stainless steel support plate 25. This stainless steel plate 25 has previously been positioned on a mortar bed to ensure that all base plates 22 will be level with one another and individually. The base plates are fixed to the stainless steel plate 25 by means of bolts 26 and associated nuts 28, which extend through the slots 24. Within each slot is placed a hollow steel spacer 29 surrounding the bolt 26. This spacer is 1 mm longer than the thickness of the base plate 22 and allows the nut 28 to be tightened without restraining the base plate 22. The bolts 26 and nuts 28 are so arranged as to allow the base plate 22, its associated column 10 and plates 12 to move radially outwardly up to the length of the slots 24 when the silo is loaded with stored material. Preferably, the lowermost plates 12 are slightly spaced from the ground so as not to impede the radial movement.

Further, the plates 12 are joined together by a horizontal bolt joint 14 which is illustrated in FIGS. 3 and 5. The panels 12 are appropriately apertured to receive the bolts. The horizontal joint between two panels 12 is made by a horizontal doubling plate 30 extending between adjacent columns 10. The horizontal plates 30 are located on the exterior of the panels 12 and as shown round headed bolts 32 with nuts on the exterior are used to join these two components together.

Figure 6:
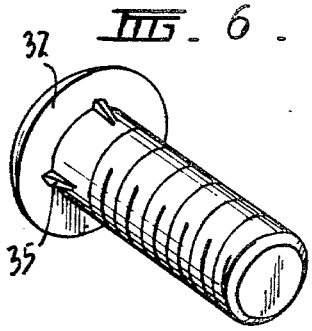
FIG. 6 illustrates a novel bolt construction of the present invention.

Preferably, the bolts 32 and associated nuts 34 are of a new construction with high tensile strength. The nuts are of larger than normal size to resist high tightening torque and the head is domed and of larger than normal size so that material in the silo will not become lodged thereon. Under the head a plurality of ribs such as three equispaced ribs 35 are formed which, when the bolt is positioned in the bolt hole with the tap of a hammer, prevent the bolt rotating during tightening of the nut. A preferred nut and bolt construction of the present invention is shown in FIG. 6.

The joint between the panels 12 is preferably sealed such as by a caulking compound.

The vertical joint between two adjacent panels 12 may have a doubling plate 36 but this is only required if the hoop stresses are higher than the capacity of the bolts in single shear. Preferably, the vertical joints are also sealed.

The doubling plate 36 is affixed to the interior walls 12 at their vertical joints by means of round headed bolts 37 which extend through flanges of the vertical columns 10 and are retained in place by nuts 37*a*.

The horizontal doubling plates 30 are curved to suit the periphery of the silo while the vertical plates 36 are flat.

The roof 20 may be constructed of an open web type truss made from steel pipes 40. Preferably, each truss is connected in the centre of the roof to a large diameter ring in order to provide an opening for loading of the material to be stored. At the edge of the roof the trusses are connected to the vertical columns 10 with a bolted on cleat. Each column 10 supporting a truss is preferably connected radially to the ring with a tie rod to ensure roundness of the silo at the top. Also, an angle iron ring may be bolted to the silo top perimeter to further assist in ensuring roundness thereof. Cladding may be of any conventional type.

The silo is typically constructed by assembling four panels and fours column sections and lifting these into position. This is continued until a ring is formed, adjacent sub-assemblies being vertically bolted together at the sametime. The next lot of sub-assemblies are placed on top and bolted horizontally to the sub-assemblies below, as well as vertically to form a ring. When roof level is reached an angle iron ring may be bolted to the top of the columns and the roof lifted into position thus completing the bins and making them ready for installation of mechanical equipment.

Fixing the horizontal doubling plates 30 externally enables a smooth internal surface to be obtained with the exception of the bolt heads. It is less important to place the vertical doubling plates 36 internally since there is preferably a vertical gap, e.g. a 10 mm gap, between the panels 12 to allow for variations and free flow of material. The outward radial movement of the column 10 produces perimetric tension in the wall panels 12. The perimetric forces are absorbed by the wall panels 12 and bolts 32.

Figure 7:
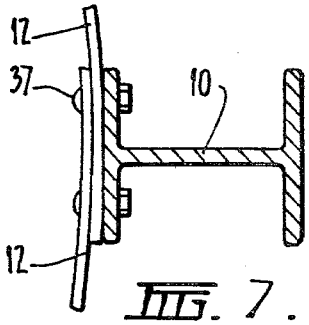
FIG. 7 is a plan view of a second form of construction and jointing of wall members of the silo of FIGS. 1 and 2.
Figure 8:
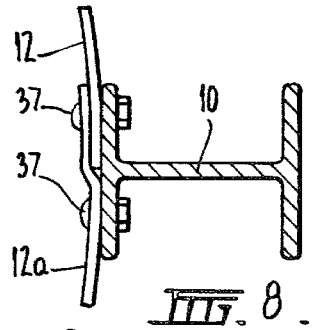
FIG. 8 is a plan view of a third form of construction and jointing of wall members of the silo of FIGS. 1 and 2.
Figure 9:
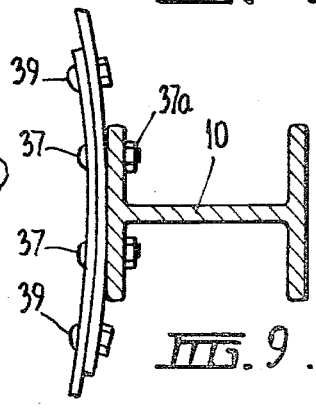
FIG. 9 is a plan view of a fourth form of construction and jointing of wall members of the silo of FIGS. 1 and 2.
Figure 10:
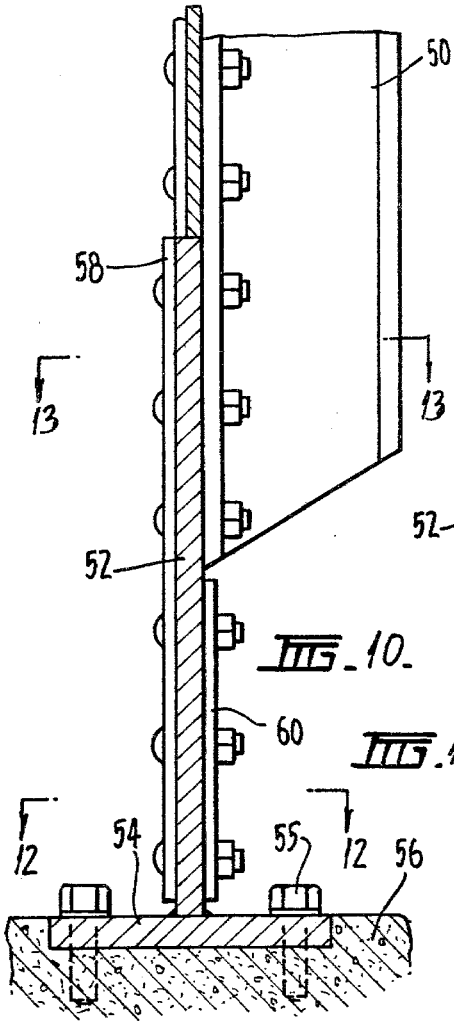
FIG. 10 is a side elevation partly in section of an alternative construction of silo in accordance with the present invention.
Figure 11:
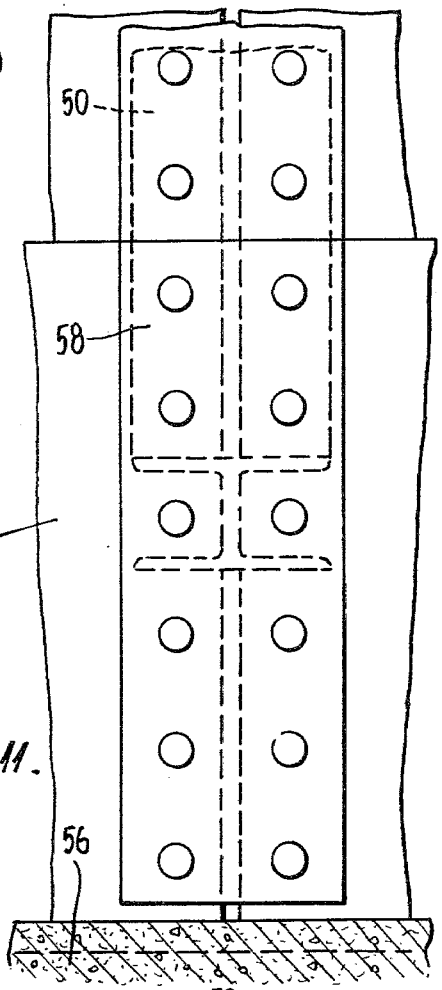
FIG. 11 is a front elevation of the silo construction shown in FIG. 10.
Figure 12:
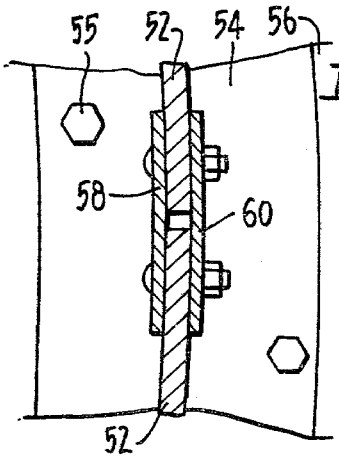
FIG. 12 is a plan view along the line 12—12 in FIG. 10.
Figure 13:
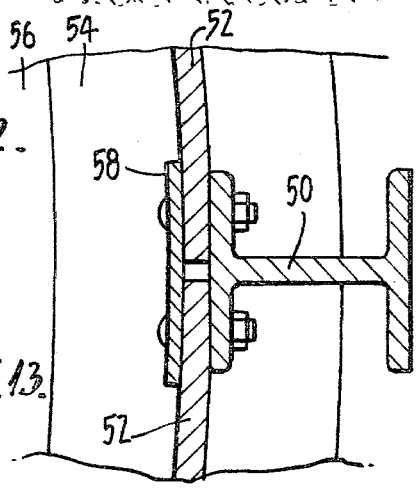
FIG. 13 is a plan view along the line 13—13 in FIG. 10.

In FIGS. 7 to 9 there are shown alternative constructions for vertically jointing panels 12.

In the arrangement shown in FIG. 7, the plates 12 are lapped in the region adjacent the column 10. The lapped portions of the plates 12 are connected together by bolts 37 extending through flanges of the column 10 and retained in place by nuts 37*a* as described above in connection with FIGS. 3 to 5. The arrangement shown in FIG. 1 avoids the need for a separate doubling plate at the vertical joints.

In the arrangement shown in FIG. 8, the plates 12 are again lapped except that a plate 12*a* is kinked to provide the overlap. In this case the extent of overlap is only about half that of the construction shown in FIG. 7 and this construction is suitable for lighter loads. As can be seen one bolt 37 extends through only one panel 12 whilst the bolt 37 illustrated extends through both panels 12.

The arrangement shown in FIG. 9 is similar to that shown in FIG. 7 except that the area of overlap is extended beyond the region adjacent the column 10. In addition to the bolts 37, the plates are connected together adjacent the extremities of the overlap by self tapping bolts 39. The arrangement shown in FIG. 9 provides for increased strength in the vertical joint and is therefore suitable for heavier loads.

The embodiment of the invention shown in FIGS. 10–13 is essentially the same as that shown in FIGS. 1 to 9 except that the columns 50 are truncated above ground level. The truncated colunns 50 are bolted at their lower ends to vertical plates 52. The plates 52 are in turn welded at their lower ends to a fixed base plate 54 which is secured in a mortar bed footing 56 by means of bolts 58. The base plate 54 is, as shown, a continuous annular member extending around the periphery of the silo.

As shown each plate 52 is of a width to extend between adjacent columns 50. The plates 52 are bolted together by means of vertical doubling plates 58 inside the silo and, below the column 50, by vertical doubling plates 60 outside the silo. Other forms of connecting the plates 52 can be employed as described above.

The arrangement described above in relation to FIGS. 10 to 13 allows even transfer of loads at the base of the silo.

The vertical plates 52 can be of varying thickness depending on the loads to be placed on them in use.

The silo constructions of the present invention are readily adaptable for installation on top of other support structures as well as being suited for a conical base. Access doors to the silo can be readily provided. Further, a centrally located emptying device is preferably provided. The size of the silo can be varied widely for any particular requirements due to the modular system employed.

The components of the silo of the present invention can be made from known material. Conveniently, the lengths of the columns 10 and wall panels 12 are arranged to facilitate transport to the construction site. Also, the wall sheets may be rolled to the required diameter before being placed in a jig for welding to form wall panels 12.

Modifications and variations such as would be apparent to a skilled addressee in the silo art are deemed within the scope of the present invention.

I claim:

1. A circular storage silo comprising a plurality of spaced-apart vertical columns arranged in a circular fashion, wall members connected to said columns to form an enclosure, a support plate member for each column mounted on the surface of the ground, a slotted base plate for each column being slidably mounted on its associated support plate, means on the support plate engageable with the slots of the base plate to provide limited radial movement of said base plates on said support plates, each of said columns being mounted on and fixedly connected to a base plate wherein said columns can move radially outwardly when said wall members are subjected to perimetric tension.

2. A silo according to claim 1, wherein the wall members comprise a plurality of panels disposed in vertical relation which are joined together by horizontal bolt joints extending between adjacent vertical columns on the exterior of the panels.

3. A silo according to claim 1, wherein the wall members comprise a plurality of panels disposed in lateral relation which are joined together by bolt means extending through the panels into the vertical columns.

4. A silo according to claim 3, wherein the lateral joints are effected by vertical doubling plates disposed internally of the silo.

5. A silo according to claim 3, wherein the lateral joints are effected by lapping the panels.

6. A circular storage silo comprising a plurality of spaced apart vertical columns having truncated lower ends and arranged in a circular fashion, a footing in the surface of the ground, base members secured to said footing, a plurality of load resistant wall members secured to said base members, and said truncated columns being secured to said wall members at a point spaced above ground level, whereby loads at the base of the silo are transferred evenly to said base members.

* * * * *